United States Patent [19]

Nakayama

[11] 4,201,040

[45] May 6, 1980

[54] WATCH MOVEMENT CONSTRUCTION

[75] Inventor: Yasuaki Nakayama, Hanno, Japan

[73] Assignee: Citizen Watch Co., Ltd., Japan

[21] Appl. No.: 896,146

[22] Filed: Apr. 13, 1978

[30] Foreign Application Priority Data

Apr. 15, 1977 [JP] Japan ..... 52-42526

[51] Int. Cl.[2] ..... G04B 19/24; G04B 33/00

[52] U.S. Cl. ..... 368/35; 368/204; 368/300

[58] Field of Search ..... 58/4 R, 4 A, 5, 23 R, 58/23 BA, 52, 58, 59, 88 R

[56] References Cited

U.S. PATENT DOCUMENTS

| | | | |
|---|---|---|---|
| 3,945,191 | 3/1976 | Berkum | 58/58 |
| 3,992,868 | 11/1976 | Tamaru et al. | 58/58 |
| 4,087,957 | 5/1978 | Miyasaka et al. | 58/59 |

*Primary Examiner*—Edith S. Jackmon

[57] ABSTRACT

A watch movement construction, in which a circuit board is mounted on one surface of a base plate and has a cutout formed at a position near an outer circumference of the movement construction to accommodate a battery in a position such that a circumferential periphery of the battery is partially aligned with the outer circumference of the movement construction whereas a calendar display member is disposed between another surface of the base plate and a time dial at a position displaced from a central portion of the base plate so that a line passing through a center of the battery, a center of the base plate and a center of the calendar display member makes an obtuse angle whereby the calendar display member and the battery are substantially not in an overlapping state thereby to reduce the thickness of the movement construction.

3 Claims, 8 Drawing Figures

WATCH MOVEMENT CONSTRUCTION

BACKGROUND OF THE INVENTION

This invention relates to the arrangement and structure of an electronic wristwatch movement equipped with a calendar.

The batteries in electronic wristwatches must be sufficiently thick in order to provide a long battery lifetime, and in conventional electronic wristwatches, the battery represents the thickest portion of the movement. Since the addition of a calendar function adds the thickness of the calendar mechanism to overall wristwatch thickness, there has been limit upon the extent of thickness reduction achievable in the case of wristwatches equipped with a calendar.

SUMMARY OF THE INVENTION

It is therefore the object of the present invention to provde an electronic wristwatch equipped with a calendar which makes it possible to overcome the abovementioned shortcomings encountered in the prior art.

DESCRIPTION OF THE PREFERRED EMBODIMENT

Figure 1:
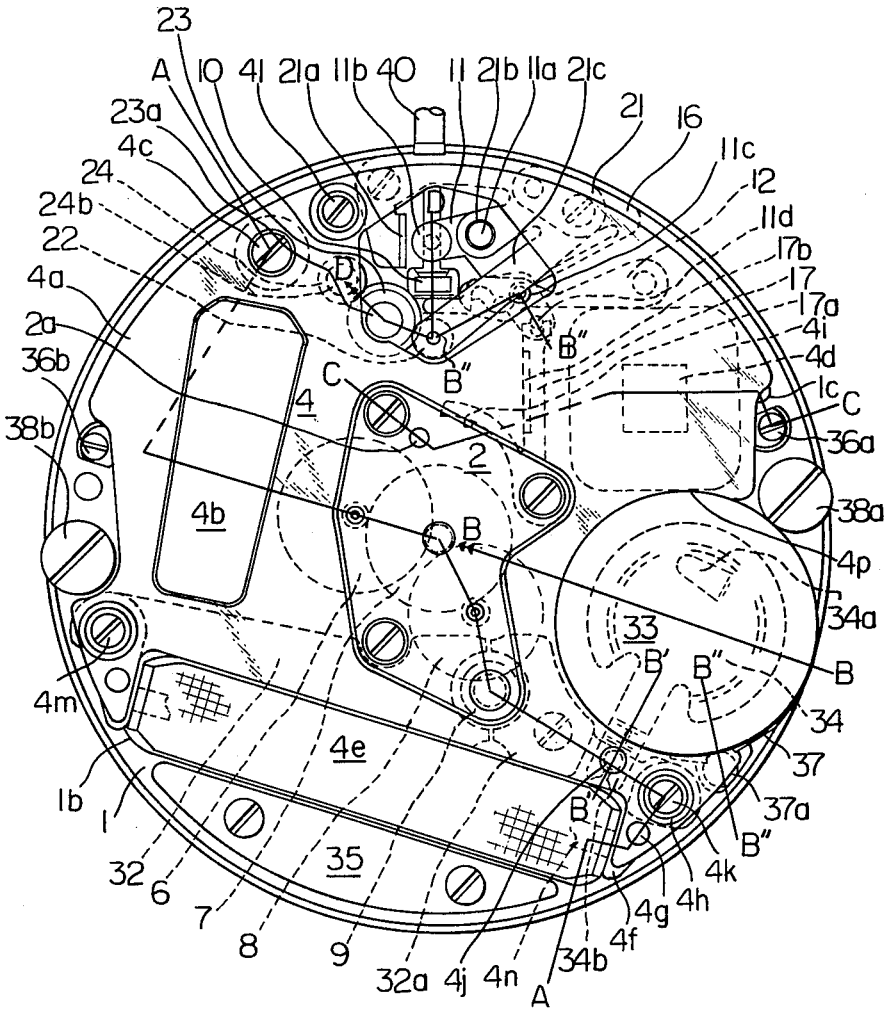
FIG. 1 is a front view of an embodiment of an electronic wristwatch equipped with a calendar according to the present invention.

FIG. 1 is a front view of an embodiment of a watch movement construction equipped with a calendar according to the present invention. Briefly, arranged on the front surface of a circular base or plate 1 are a reduction wheel train mechanism at the center of the watch movement construction, an electro-mechanical transducer at the bottom, a battery section and a portion of the electronic circuitry at the right, the remaining portion of the electronic circuitry at the left, and a winding stem setting device as well as a portion of a calendar correction mechanism at the top. The reduction wheel train is composed of a third wheel and pinion 6, fourth wheel and pinion 7 and fifth wheel and pinion 8 axially supported at the top by means of a wheel train bridge 2. The electromechanical transducer, which in this case is a stepping motor, includes as main components a coil **4*e* and rotor 9 secured to a circuit board 4*a* which covers almost the entire front surface of plate 1, as shown by the oblique lines, as well as a yoke 32 to which is secured a yoke plate 32*a* that bestrides a hole for insertion of the rotor 9. Coil 4*e* includes a plastic winding frame 4*f* at both ends of a coil winding core 4*h* made of a magnetic material, and is attached to circuit board 4*a* by means of a riveted portion 4*g* or the like. Coil 4*e* possesses a spindle-shape and fits perfectly in an elongated hole 1*b* formed in plate 1. The coil 4*e* can be designed so as to possess a sufficient length and thickness which are necessary for a high stepping motor output and overall thickness reduction. A magnetic shield block 35 made of a magnetic material is screwed onto plate 1. The battery section comprises a battery 33, a battery seat 34 equipped with a negative electrode contact 34*a*, and a positive electrode contact 37 supported by a rivet 37*a*. Battery seat 34 includes a spring portion 34*b* which embraces a pin 4*j* secured to circuit board 4*a* and serves both as a conductive and fixing member. An electronic circuit block 4 comprises an IC chip 4*d*, a resin potting 4*i*, trimmer condenser 4*c* and quartz crystal vibrator 4*b* mounted on circuit board 4*a*. Although the circuit board also possesses a printed conductive pattern on its rear side, the pattern is not shown for the sake of simplicity. Circuit board 4*a* is secured to plate 1 by metal washers 4*h* and screws 4*k*, 4*l* and 4*m*. Screws 4*k* and 4*m* also serve to intimately connect coil winding core 4*n* and yoke 32**.

The winding stem setting device and calendar correction mechanism are constructed as follows. A setting lever 11 secured to a pin **11*b* which is fitted in the slot of a winding stem 40 is capable of pivoting about a setting lever shaft 11*a*, and a clutch lever 12 having a V-shaped hole into which a setting lever pin 11*c* is loosely fitted engages with the groove of a clutch wheel 10 which, as is well known in the art, is caused to rock by pulling out the winding stem 40. At the back of the clutch lever 12 is a setting lever spring 16 the tip of which is in abutting contact with setting lever pin 11*c*. Engaged with a second setting lever pin 11*d* is a reset lever 17. When winding stem 40 is pulled out to the maximum extent, rotating the stem in the counter-clockwise direction as far as possible brings a brake portion 17*a* into pressured contact with the teeth of fourth wheel and pinion 7. The brake portion 17*a* receives a counter-reactive force due to a hand-setting operation, and a contact spring 17*b* bent at its upper side comes into contact with the printed pattern (not shown) on circuit board 4*a*, thereby resetting the electronic circuitry. A correction lever 21 which bestrides winding stem 40 restrains the displacement of the winding stem in the direction of its upper surface, and, when the pin 11*b* of setting lever 11 disengages from winding stem 40, a bent portion 21*a* is supported at the point 11*b*. A lever 21*b* acts as a spring to bias setting lever 11 toward plate 1, and another lever 21*c* has rotatably attached to one end a correction transmission wheel (I) 22 which meshes with the clutch wheel 10, and has at its central portion a bent portion which engages with the setting lever pin 11*c*. Rod 21*c* also applies a spring force in the direction of plate 1. Since the bent portion is high enough so as not to strike the setting lever pin 11*c* over the intermediate portion of the distance of travel of the pin, the correction transmission wheel (I) 22 is biased by the spring force toward the plate 1 with the winding stem 40 pulled out to the second of three steps. Reference numeral 23 denotes a correction transmission wheel (II) which is rotatably attached to plate 1 by means of a rivet 23*a* and normally meshed with correction transmission wheel (I) 22 and another correction transmission wheel (III) 24. A rivet 24*b* maintains a suitable torque with correction transmission wheel (III) 24 the rotational motion of which is transmitted to the correction mechanism on the rear surface of plate 1. Reference numerals 36***a*, 36*b* designate eccentric shafts which secure the watch dial whose feet are inserted into holes 1*c* in plate 1. Reference numerals 38*a*, 38*b* denote watch case set screws, the former set screw serving to secure battery 33.

Figure 2:
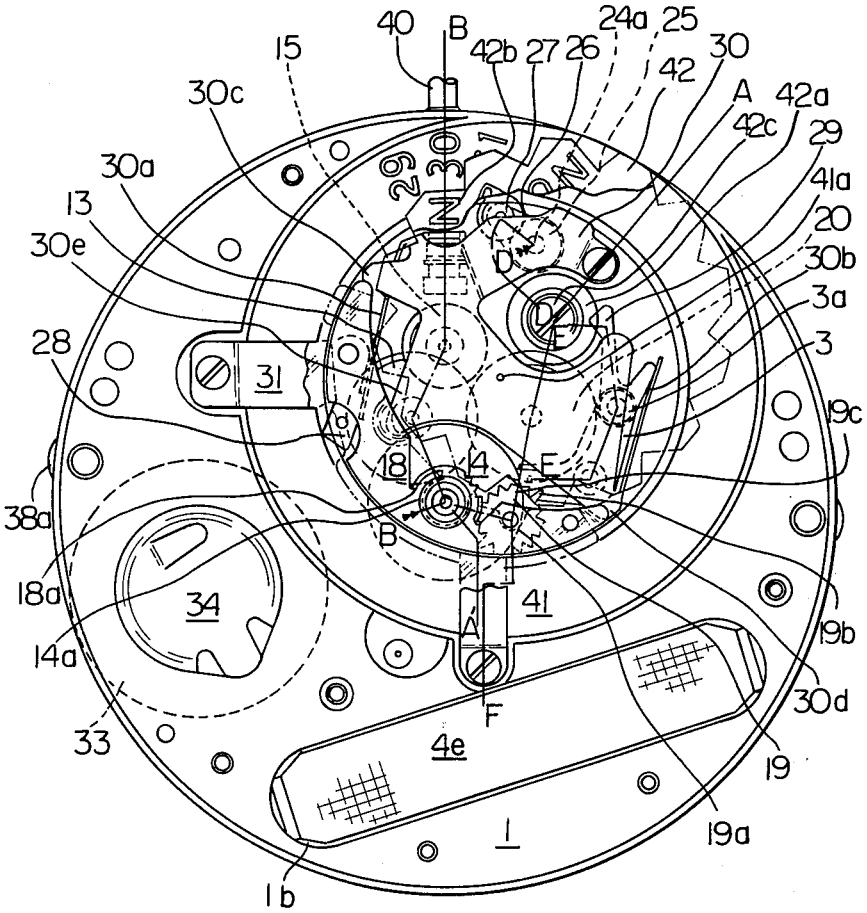
FIG. 2 is a rear view of FIG. 1.

FIG. 2 is a rear view of FIG. 1. Briefly, a calendar device is located at the upper right, a battery portion at the lower left, and the previously described coil 4*e* can be seen through the hole 1*b*. A date dial of a calendar display member rotates about a center 41*a* displaced from a rotational axis of time indicating hands, and overlapping the date dial is day dial 42, largely indicated by a two-dot chain line, rotatable about a daily star 42*a*. Provided in the vicinity of winding stem 40 in the axial direction thereof is a dial calendar window which allows the date and day dials to be read. The letters 42*b* are printed on the day dial 42 at positions closer to the center of the watch than the numbers on the date dial, and the outer circumference of the day dial is suitably cut to allow the numbers to be read. A date wheel dial 18 outside the outer circumference of day dial 42 and on the inside of date wheel 41 supports the groove of hour wheel 14 at its spring portion 18*a*, and a date wheel 19 is rotatably attached by means of a pin 19*a*. The shaft 14*a* of hour wheel 14 includes three teeth, the remaining portion of the shaft having a circular circumference. Date wheel 19 has two toothed portions and four pairs of engaging portions 19*c*, and is equipped with a long tooth portion 19*b* located symmetrically between the projecting members of each toothed portion. The long tooth portions 19*b* mesh with the teeth on the inner circumference of date dial 41. The meshing state between date wheel 19 and shaft 14*a* of hour wheel 14 is one type of Geneva mechanism, the date wheel 19 rotating through ½ turn each day. In the present embodiment, this Geneva mechanism makes it possible to minimize the space for the calendar mechaniam. Moreover, placing both mechanisms on the date wheel dial 18 prevents meshing errors when assembling and disassembling the wristwatch. A thin plate on the inside of the day dial 42 is a minute wheel setting lever spring 30 attached to plate 1 by one screw and by retention portions 30*c*, 30*d*, and 30*e* at three places on date wheel dial 18. These portions of the date wheel dial are slightly raised by bending. Minute wheel setting lever spring 30 also has spring portions 30*a*, 30*b* formed by bending at two places, each of the spring portions applying pressure to a date jumper 28 and daily jumper 29. Below minute wheel setting lever spring 30 are a setting wheel 15, minute wheel 13, a daily transmission wheel 20 which meshes with the long tooth portions 19*b* of date wheel 19, a correction transmission wheel (IV) 25 which is rotated by correction transmission wheel (III) 24 via shaft 24*a*, a rocking lever 26 maintaining a suitable sliding torque with shaft 24*a*, and a correction wheel 27 carried on the lever 26. When a correction is made, the direction in which rocking lever 26 rocks is decided by the direction of rotation of winding stem 40, so that correction wheel 27 either meshes with daily star 42*a* or date dial 41. This portion of minute wheel setting lever spring 30 is bent slightly upward and, to a small extent, seats date dial 41. A date dial spring 31 almost entirely indicated by a two-dot chain line and partially shaded with oblique lines has substantially the same shape as date wheel dial 18 but also includes enlarged portions that form two legs which bestride date dial 41. Screwing down the legs presses date dial spring itself as well as date wheel dial 18 against plate 1. Reference numeral 3 denotes a third wheel bridge which is fixed to plate 1 by pins 3*a*. Battery 33 at the lower left portion of the drawing slightly overlaps date dial 41. Reference numeral 34 designates a battery seat visible through a hole in plate 1.

Figure 3:
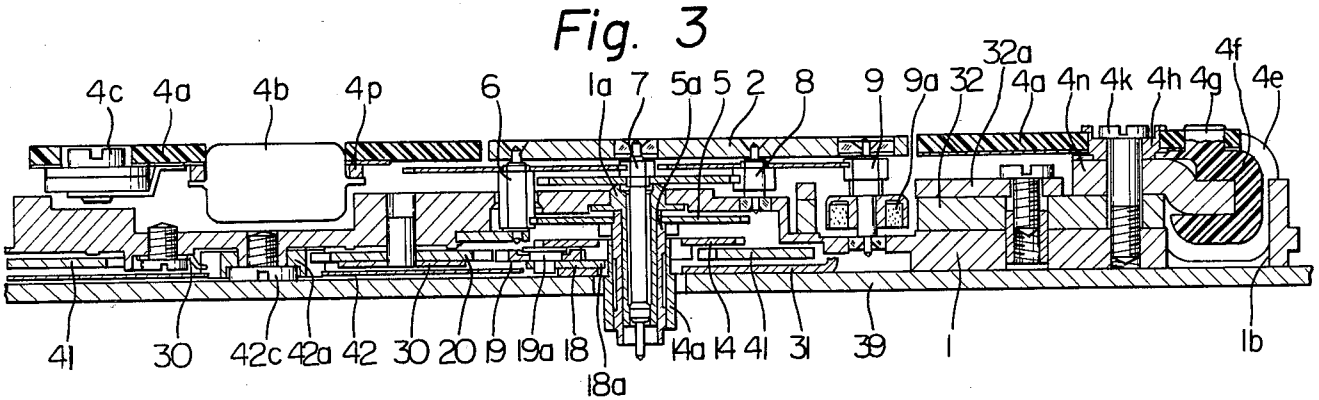
FIG. 3 is a cross-sectional view taken along the line A—A of FIG. 1 and the line A'—A' of FIG. 2.

FIG. 3 is a composite cross-sectional veiw of the main portions of FIGS. 1 and 2 taken along the lines A—A and A′—A′, respectively. In order to limit the thickness of the movement, the shaft of a trimmer condenser 4*c* is inserted in a hole formed in circuit board 4*a*, and the quartz crystal vibrator 4*b* is similarly inserted into a large hole in the circuit board, after which the condenser and vibrator are secured. Reference numeral 4*p* represents a spacer which makes use of a flange for a cold welding process and also serves as a buffer. The center of the drawing shows the wheel train portion, namely the third wheel and pinion 6, fourth wheel and pinion 7, fifth wheel and pinion 8, rotor 9 and wheel train bridge 2, as described above. Coil 4*e* is positioned on circuit board 4*a* via coil winding frame 4*f* and is secured by means of riveted portion 4*g*. The hole 1*b* in plate 1 is as small as possible but large enough to allow insertion of coil 4*e* and coil winding frame 4*f*. Since coil 4*e* is approximately the same size as the thickness of the movement, core 4*n* is slightly bent over yoke 32 the height of which is determined by the height of magnet 9*a* of rotor 9. Reference numeral 32 denotes the yoke plate. In the present embodiment, the calendar device and coil 4*e* can be arranged without overlapping, and the coil 4*e* can be provided with a sufficient thickness. Reference numeral 4*h* denotes a washer caulked to circuit board 4*a* and serves to protect the circuit board from damage when screw 4*k* is tightened, and does not permit the head of the screw to project excessively from the surface of the circuit board. Loosely fitted over a center shaft 1*a* pressed into and secured to plate 1 is a cannon pinion 5*a* which maintains s suitable torque with second wheel and pinion 5. About the center shaft 1*a* is loosely fitted shaft 14*a* to which hour wheel 14 is secured. Shaft 14*a* is provided with a plurality of teeth about the portion of maximum diameter and, as explained with reference to FIG. 2, the teeth engage with date wheel 19 to which is rotatably secured, by means of a rivet 19*a*, data wheel dial 18 having spring portion 18*a* that supports shaft 14 of hour wheel 14. Shown at the center of the right hand portion of the drawings are date dial 41 the inner circumference of which is adjacent to the maximum diameter of shaft 14*a*, and date dial spring 31 secured to time dial 39. Daily transmission wheel 20 which rotate so as to mesh with date wheel 19 once per day is located between minute wheel setting lever spring 30 and plate 1. Rotation of daily transmission wheel 20 is transmitted to daily star 42*a* which is rotatably attached to plate 1 by screw 42*c* and to which is secured day dial 42. At the left side of the drawing, date dial 41 and day dial 42 are in approximate agreement with the outer circumference of plate 1.

Figure 4:
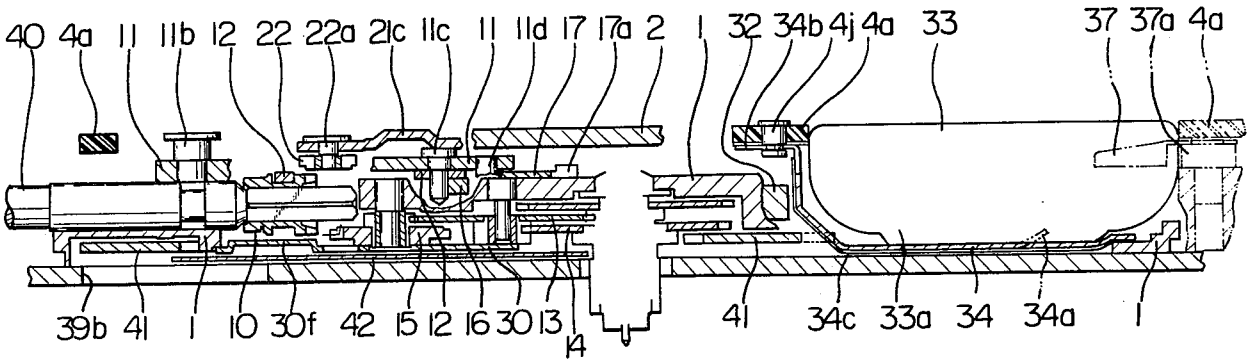
FIG. 4 is a cross-sectional view taken along the line B—B of FIG. 1 and FIG. 2 and along the lines B'—B', B''—B'' and B'''—B''' of FIG. 1.

FIG. 4 shows the path from line B—B of FIG. 1 to line B—B of FIG. 2 and represents a cross-sectional view taken along the lines B′—B′, B″—B″ and B‴—B‴ of FIG. 1. Setting lever 11 secured to pin 11*b* which fits into the slot of winding stem 40 not only operates setting lever spring 16 and clutch lever 12 having a cam portion into which setting lever pin 11*c* loosely fits, but also operates lever 21*c* of correction lever 21 which is moved in the direction of movement thickness by the head of setting lever pin 11*b*. Clutch wheel 10 is operated by clutch lever 12 and, depending upon the position to which winding stem 40 has been pulled out, meshes with setting wheel 15 and with correction transmission wheel (I) 22 rotatably carried on rod 21c of correction lever 21 by means of rivet 22a. One other setting lever pin 11d engages with reset lever 17, and the brake portion 17a applies pressure to fourth wheel and pinion 7 when a reset operation is to be accomplished. Minute wheel 13 and setting wheel 15 which mesh with hour wheel 14 are supported by minute wheel setting lever spring 30 having a projection 30f which supports clutch wheel 10 during assembly and disassembly. Battery 33 is supported from below by battery seat 34 having an insulating coat 34c, the spring portion 34b of battery seat 34 being removable by means of pin 4j secured to circuit board 4a. The negative electrode contact spring 34a that contacts battery 33 is indicated by the two-dot line and shown in the nondepressed state. A rivet 37a loosely fits into positive electrode contact spring 37 which presses circuit board 4a from above. The overlapping condition between battery 33 and date dial 41 is shown by the two-dot chain line slightly to the right of center of the drawing. Even though there is a slight horizontal overlap, the date dial does not overlap the battery at the thickest part, thereby providing a thinner movement. The window 39b in dial 39 allows date dial 41 and day dial 42 to be read in a continuous state.

Figure 5:
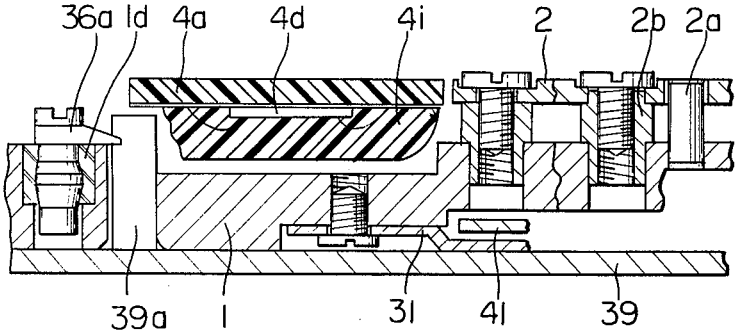
FIG. 5 is a cross-sectional view taken along the line C—C of FIG. 1.

FIG. 5 is a cross-sectional view taken along the line C—C of FIG. 1. An eccentric shaft 36a press fitted into a plastic resin sleeve 1d located in a hole formed in plate 1 secures the leg 39a of dial 39 by means of a flange portion. An IC chip secured directly to circuit board 4a is covered with a resin potting 4i. In order to reduce thickness, the length of a guide portion with supporting column 2b is shorter than the upper part of the wheel train shaft. Since this makes assembly difficult, pin 2a is loosely fitted into the tip of the wheel train shaft and, by guiding the wheel train bridge 2, assembly is facilitated. A portion of the leg of date dial spring 31 which bestrides date dial 41 is partially shown in the screwed down state.

Figure 6:
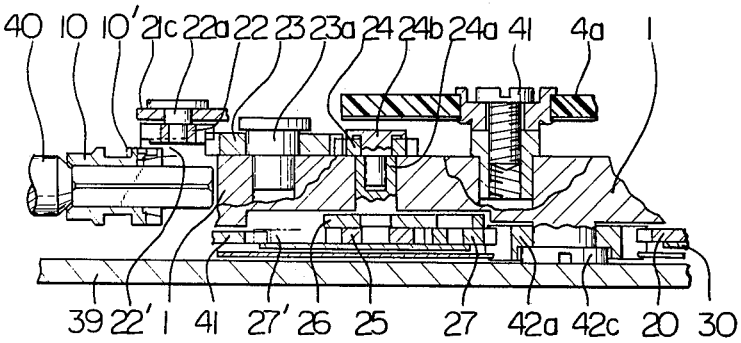
FIG. 6 is a cross-sectional view taken along the line D—D of FIG. 1 and FIG. 2.

FIG. 6 is a cross-sectional view taken along the line D—D of FIG. 1 and the line D—D of FIG. 2. When clutch wheel 10 loosely fitted into the angled portion of winding stem 40 is set in the calendar correction state, it assumes the position 10' indicated by the two-dot chain line. In addition, correction transmission wheel (I) 22 attached to rod 21c of correction lever 12 by means of rivet 22a assumes the position 22' as indicated by the two-dot chain line, so that rotation of winding stem 40 ultimately is transmitted to correction transmission wheel (II) 23 which is rotatably mounted on plate 1 by rivet 23a. Correction transmission wheel (III) 24 is narrowed between rivet 24b having a resilient collar and shaft 24a, whereby a suitable torque is produced so that rotation is transmitted to correction transmission wheel (IV) 25. This is arrnaged so that no damage will result even if date wheel 19 is corrected when daily star 42a is meshing with date dial 41 or dialy transmission wheel 20. Rocking lever 26 which carries correction wheel 27 is fitted so as to produce a suitable sliding torque with shaft 24a. Accordingly, correction wheel 27 either meshes with daily star 42a or date dial 41, indicated by the two-dot chain line at 27' depending upon the direction of rotation of shaft 24a. Minute wheel setting lever spring 30 supports these members as well as daily transmission wheel 20. The head of screw 42c which locks daily star 42a against rotation supports dial 39. Set screw 41 secures circuit board 4a.

Figure 7:
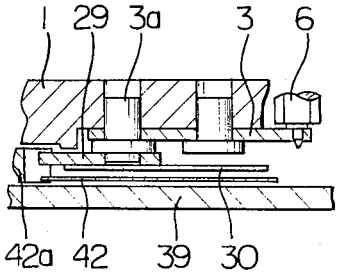
FIG. 7 is a cross-sectional view taken along the line E—E of FIG. 2.

FIG. 7 is a cross-sectional view taken along line E—E of FIG. 2. A third wheel bridge 3 secured to plate 1 by rivets 3a supports the lower end of the shaft of third wheel and pinion 6. Daily jumper 29 which determines the rotational position of daily star 42c is mounted on the rivet 3a and supported by minute wheel setting lever spring 30.

Figure 8:
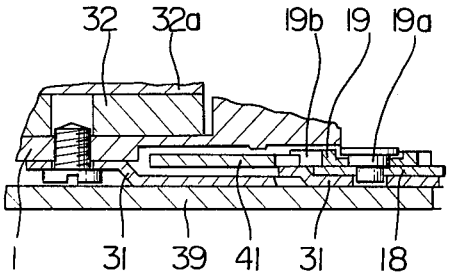
FIG. 8 is a cross-sectional view taken along the line F—F of FIG. 2.

FIG. 8 is a cross-sectional view taken along the line F—F of FIG. 2. Date dial spring 31 at the rear surface of yoke 32 has a bent portion which supports date dial 41 and is shown biasing date wheel dial 18 which axially supports date wheel 19, and is also shown supporting dial 39. In the drawing, the long tooth portion 19b of date wheel 19 is illustrated meshing with the toothed portion of date dial 41.

In the present embodiment, date dial 41 and day dial 42 do not project beyond the outer diameter of plate 1; however, it is possible to adapt an arrangement where the dials do project slightly. In such a case, the projecting portion will assume a portion of the space in the rim of the movement.

The present invention as described above enables a battery and calendar mechanism which occupy comparatively large volumes to be suitably arranged in an electronic wristwatch equipped with a calendar so that other wristwatch elements may also be effectively arranged. The present invention therefore provides a calendar-equipped electronic wristwatch which is much thinner than similar wristwatches according to the prior art.

It will now be appreciated that in accordance with the present invention a circuit board is mounted on one surface of a base plate and has a cutout 4p formed at a position near an outer circumference of the movement construction to accommodate a battery in a position such that a circumferential periphery of the battery is partially aligned with the outer circumference of the movement construction whereas a calendar display member is disposed between another surface of the base plate and a time dial at a position displaced from a central poriton of the base plate so that a line passing through a center of the battery, a center of the base plate and a center of the calendar display member makes an obtuse angle whereby the calendar display member and the battery are substantially overlapping state to reduce the thickness of the movement construction. It should also be noted that the calendar display member comprises a ring-shaped date dial having a first portion with its outer periphery being in substantially coincident with the outer circumference of the movement construction, and a second portion located between at least the reduced diameter portion 33a of the and a rotational axis of the reduction wheel train mechanism.

What is claimed is:

1. A movement construction for an electronic wristwatch powered by a battery having a reduced diameter portion comprising:

a base plate;

a reduction wheel train mechanism provided at a central portion of said base plate;

a time dial mounted on one surface of said base plate;

a circuit board mounted on another surface of said base plate and having a cutout formed at a position near an outer circumference of said movement construction to accommodate said battery in a fixed place such that a circumferential periphery of said battery is partially aligned with the outer circumference of said movement construction; and a calendar display member disposed between the front surface of said base plate and said time dial and having its center displaced from the central portion of said base plate so that a line passing through a center of said battery, a center of said base plate and a center of said calendar display member makes an obtuse angle whereby said calendar display member and said battery are substantially out of overlapping state to reduce the thickness of said movement construction.

2. A watch movement construction as claimed in claim 1, in which said calendar display member comprises a ring-shaped date dial having a first portion with its periphery being in substantially coincident with the outer circumference of said movement construction, and a second portion located between at least the reduced diameter portion of said battery and a rotational axis of said reduction wheel train mechanism.

3. A watch movement construction as claimed in claims 1 or 2, further comprising an electromechanical transducer having a coil, and in which said base plate has an elongated hole formed therein at a position away from outer circumferences of said battery and said calendar display member, and said coil being accommodated in said elongated hole.

* * * * *